US008683620B1

(12) United States Patent
Krumme

(10) Patent No.: US 8,683,620 B1
(45) Date of Patent: Apr. 1, 2014

(54) POOL COVERS

(76) Inventor: John F. Krumme, Woodside, CA (US)

( * ) Notice: Subject to any disclaimer, the term of this patent is extended or adjusted under 35 U.S.C. 154(b) by 871 days.

(21) Appl. No.: 12/799,781

(22) Filed: Apr. 29, 2010

Related U.S. Application Data

(60) Provisional application No. 61/214,944, filed on Apr. 29, 2009.

(51) Int. Cl.
*E04H 4/00* (2006.01)

(52) U.S. Cl.
USPC ..... 4/498

(58) Field of Classification Search
USPC ..... 4/498, 503
See application file for complete search history.

(56) References Cited

U.S. PATENT DOCUMENTS

| | | | | |
|---|---|---|---|---|
| 3,872,522 | A * | 3/1975 | Bennett et al. | 4/498 |
| 3,984,881 | A | 10/1976 | Gerlach | |
| 4,022,187 | A | 5/1977 | Roberts | |
| 4,270,232 | A | 6/1981 | Ballew | |
| 4,284,060 | A | 8/1981 | McCluskey | |
| 4,291,672 | A | 9/1981 | Ricks | |
| 4,366,806 | A | 1/1983 | Acker | |
| 4,601,072 | A * | 7/1986 | Aine | 4/499 |
| 4,749,606 | A | 6/1988 | Moore | |
| 4,875,466 | A | 10/1989 | Slonneger | |
| 5,067,182 | A | 11/1991 | Koelsch | |
| 5,350,544 | A | 9/1994 | Bambara | |
| 5,398,349 | A | 3/1995 | Haberler | |
| 5,643,517 | A | 7/1997 | Wu | |
| 5,647,784 | A | 7/1997 | Moran | |
| 5,688,454 | A | 11/1997 | Chi | |
| 5,911,193 | A * | 6/1999 | Johnson | 119/28.5 |
| 6,586,074 | B1 | 7/2003 | Lee | |
| 6,640,353 | B1 | 11/2003 | Williams | |
| 6,673,241 | B1 * | 1/2004 | Tung et al. | 210/242.1 |
| 7,093,593 | B2 | 8/2006 | Rosene | |
| D534,488 | S | 1/2007 | Rosene | |
| 7,201,958 | B2 | 4/2007 | Stimler | |
| D569,527 | S | 5/2008 | Rosene | |

* cited by examiner

*Primary Examiner* — Huyen Le
(74) *Attorney, Agent, or Firm* — T. H. P. Richardson

(57) ABSTRACT

A device for covering a pool, for example a swimming pool, has an upper component composed of a closed cell polymeric foam and a lower component composed of an open cell polymeric foam. The device can have, or can acquire in use, a convex upper surface which reduces the danger that it will be blown off the pool by wind.

18 Claims, 2 Drawing Sheets

FIG. 1
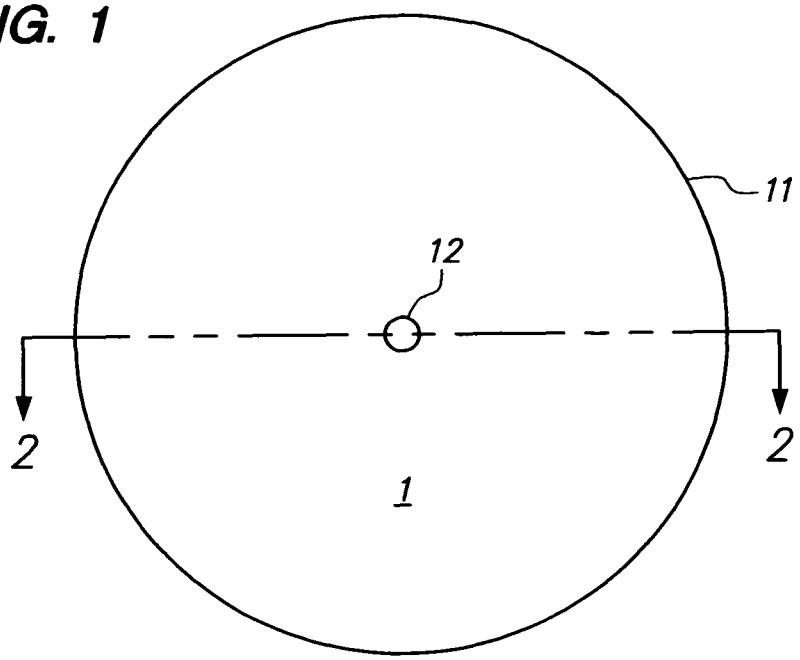
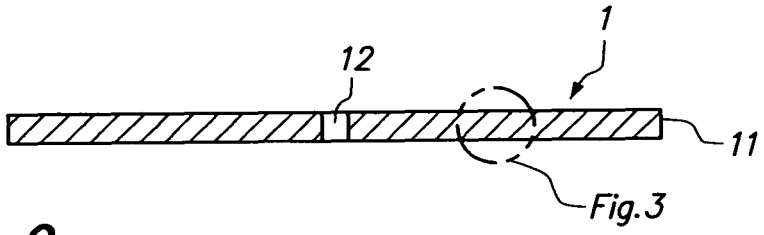
FIG. 2
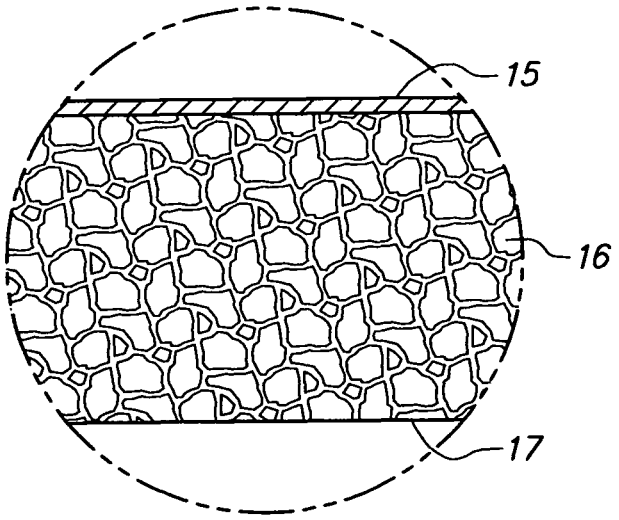
FIG. 3

FIG. 4
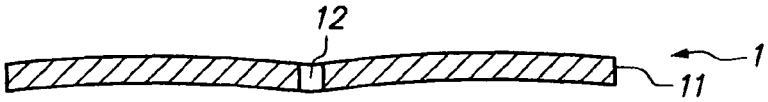
FIG. 5
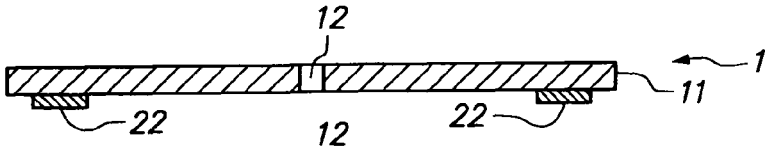
FIG. 6
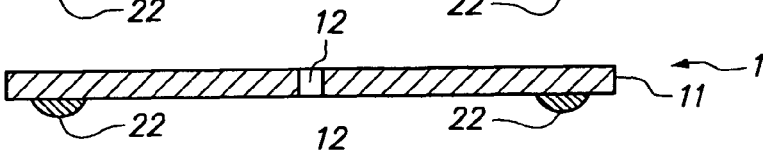
FIG. 7
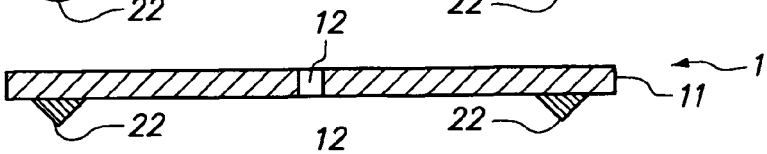
FIG. 8
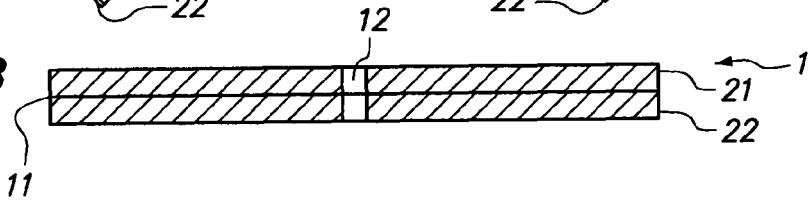
FIG. 9
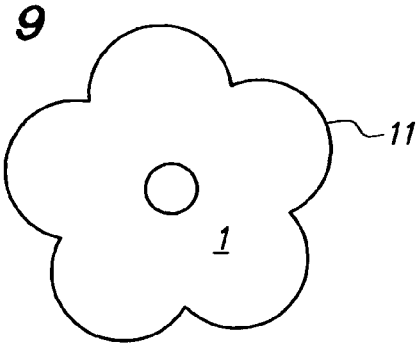
FIG. 10
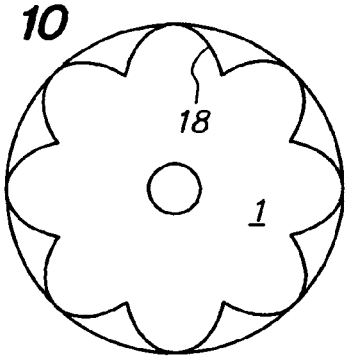
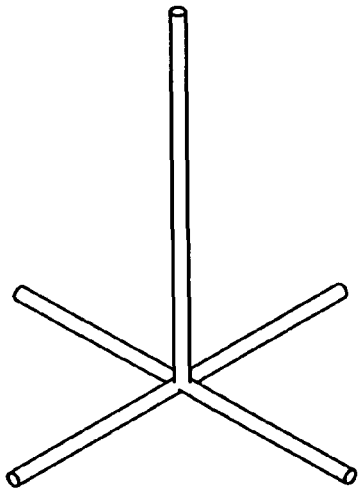
FIG. 11

POOL COVERS

CROSS-REFERENCE TO RELATED APPLICATION

This application claims priority from my U.S. provisional patent application No. 61/214,944, filed Apr. 29, 2009. The entire disclosure of that application is incorporated herein by reference for all purposes.

BACKGROUND OF THE INVENTION

1. Field of the Invention

This invention relates to the covering of pools.

2. Introduction to the Invention

Various methods of covering pools (i.e. bodies of liquid having an exposed surface), for example swimming pools, are known. Reference may be made, for example, to U.S. Pat. Nos. 3,984,881, 4,022,187, 4,270,232, 4,291,672, 4,284,060, 4,366,806 4,749,606, 4,875,466, 5,067,182, 5,398,349, 6,571,789 and 7,093,593, the entire disclosure of each of which is incorporated herein by reference for all purposes.

SUMMARY OF THE INVENTION

I have discovered novel devices and methods for covering pools, particularly pools containing aqueous liquids, for example swimming pools and spas. The devices are also called "covering members" in this specification In a first aspect, the invention provides a novel device which will float on the surface of a pool of liquid and which comprises (1) an upper generally laminar component which has a relatively low ability to absorb the liquid, and preferably has an upper surface which is substantially impermeable to the liquid, and (2) a lower component which (i) is secured to the upper component and (ii) has a relatively high ability to absorb the liquid.

When such a device is maintained on the exposed surface of a pool, the relatively high absorption of the liquid by the lower component helps to maintain the device on the surface of the pool. This reduces the danger that wind will blow the device off the surface of the pool, and in a pool having an "infinity" edge, reduces the danger that the device will slip over the infinity edge. Preferably, at least part of the upper surface of the upper component is convex, which further reduces the danger that wind will blow the device off the surface of the pool, and can provide additional advantages, as discussed below.

In a second aspect, the invention provides a novel device which will float on the surface of a pool of liquid and which comprises (1) an upper generally laminar component having an upper surface which (i) is at least partially convex, (ii) when the device is in use, is above the surface of the liquid, and preferably (iii) is substantially impermeable to the liquid, and (2) a lower component which (i) is secured to the upper component, (ii) will absorb the liquid, and (iii), when the device is in use, absorbs the liquid and is below the surface of the liquid.

As noted above, in connection with a preferred feature of the first aspect, the convex upper surface reduces the danger that wind will blow the device off the surface of the pool. When the pool has an "infinity edge", there is also less danger that the device will slip over the edge of the pool. A convex shape can also be useful in shedding water and/or debris from the top surface of the device, and, in suitable cases, in making the device more effective in transferring solar heat to the water in the pool. The convex shape can for example be such that, when the device is horizontal, the highest point on the convex surface is at least 0.5 inch higher, e.g. 0.5-3 inch higher or 1-2 inch higher, than the lowest point on the convex surface. The lowest point on the convex surface can for example be around the outer periphery of the device and/or around inner periphery of the device.

In a third aspect, the invention provides a novel device which will float on the surface of a pool of liquid and which comprises (1) a generally laminar upper component which (i) has an upper surface which, when the device is in use, is above the surface of the liquid and (ii) is composed of a closed cell polymeric foam, and (2) a lower component which (i) is secured to the upper component, and (ii) is composed of an open cell polymeric foam.

In some cases, absorption of liquid by the lower component (when the device is in use) can cause the upper surface of the device, even if it is initially substantially planar, to become at least partially convex.

In the devices of the third aspect of the invention, and in preferred devices of the first and second aspect of the invention, the upper component comprises a closed cell polymeric foam and the lower component comprises an open cell polymeric foam. The polymeric foam can for example have a density of 1-10, e.g. 1.5-7, pounds per cubic foot. The polymer can be any polymeric composition which has the desired color, e.g. through the inclusion of dyes and/or pigments, and which has a useful life when in contact with the liquid in the pool and exposed to sunlight, for example through the inclusion of UV and/or other stabilizers The polymeric composition can, for example, be based on cross-linked polyethylene or another polyolefin. A polymeric compositions of the upper and lower components can be the same or different.

The devices of the invention can have any suitable shape. For covering swimming pools, particularly useful devices have an outer periphery 60-300 inch long and have a hole which passes through the device, the hole having an inner periphery 5-40 inch long, and being positioned so that the distance between each point on the inner periphery and the closest point on the outer periphery is 6-36 inches, and preferably all the distances are substantially the same. The hole, particularly when it is at or near the center of the device, simplifies the handling of the device, for example by means of a pole having a hook which can be inserted into the hole. The hole also makes it possible, when the devices are not being used to cover the pool, to stack the devices on a stand, for example from a stand having a pole extending vertically from a base. The stand can rest on the ground or extend from a fence. Alternatively or additionally, the stand can be constructed so that it will float on the pool, either on its own, or when stabilized by means of a single device which is fitted over the pole and rests on the base. Such stands, particularly when loaded with covering members, provide a fourth aspect of the present invention.

In a fifth aspect, this invention provides a method of making a device suitable for use as a covering member for a pool, the method comprising skiving a closed cell polymeric foam sheet, and cutting the skived product into covering members, preferably having the dimensions set out above.

In a sixth aspect, this invention provides a method of covering an exposed surface of a pool, the method comprising maintaining a plurality of covering members on the surface, the covering members being devices as defined in one or more of the first, second and third aspects of the invention.

BRIEF DESCRIPTION OF THE DRAWINGS

The invention is illustrated in the accompanying drawings, which are diagrammatic and not to scale, and in which FIG. 1 is a plan view of a device of the invention, FIG. 2 is a cross-section on line II-II of FIG. 1, before the device has been placed on water, FIG. 3 is an enlargement of part of FIG. 2, FIG. 4 is a cross-section on line II-II of FIG. 1, after the device has been floating on water for some time and the upper surface has acquired an convex shape, FIGS. 5-8 are cross-sections of devices similar to that shown in FIG. 1 but having two distinct layers, FIG. 9 is a plan view of a device similar to that shown in FIG. 1 but having a decorative shape, FIG. 10 is a plan view of a device similar to that shown in FIG. 1 but having decoration painted or stenciled thereon, and FIG. 11 is a perspective view of a stand.

DETAILED DESCRIPTION OF THE INVENTION

In the Summary of the Invention above, the Detailed Description of the Invention below, and the accompanying drawings, reference is made to particular features of the invention. It is to be understood that the disclosure of the invention in this specification includes all appropriate combinations of such particular features. For example, where a particular feature is disclosed in connection with a particular aspect, a particular embodiment, or a particular Figure, that feature can also be used in connection with other particular aspects, embodiments and Figures (except where the context excludes that possibility), and in the invention generally.

The term "comprises" and grammatical equivalents thereof are used herein to mean that other elements (i.e. components, ingredients, steps etc.) are optionally present. For example, an assembly "comprising" (or "which comprises") components A, B and C can contain only components A, B and C, or can contain not only components A, B and C but also one or more other ingredients. The term "consisting essentially of" and grammatical equivalents thereof is used herein to mean that other elements may be present which do not materially alter the claimed invention. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility). The term "at least" followed by a number is used herein to denote the start of a range beginning with that number (which may be a range having an upper limit or no upper limit, depending on the variable being defined). For example "at least 1" means 1 or more than 1, and "at least 80%" means 80% or more than 80%. When, in this specification, a range is given as "(a first number) to (a second number)" or "(a first number)-(a second number)", this means a range whose lower limit is the first number and whose upper limit is the second number. For example, "from 1 to 2 inch" or "1-2 inch" means a range whose lower limit is 1 inch, and whose upper limit is 2 inch The numbers given herein should be construed with the latitude appropriate to their context and expression; for example, each number is subject to variation which depends on the accuracy with which it can be measured by methods conventionally used by those skilled in the art. The terms plural and plurality are used herein to denote two or more than two items.

The thickness of the upper component is often uniform, but can vary continuously and/or discontinuously. When it varies, the thickness will generally be the same at all points which are the same distance from the outer periphery. The thickness of the lower component is often uniform, but can vary continuously and/or discontinuously. When it varies, the thickness will generally be the same at all points which are the same distance from the outer periphery. The lower component can be coextensive with the lower surface of the upper component, or can cover only part of the lower surface of the upper component. When it covers only part of the lower surface, it will generally cover one or more areas which are uniformly spaced from the outer periphery; for example, the lower component can be an annular member having an outer edge which is coincident with, or inset from, the outer periphery. When there is a lower component which covers only part of the lower surface of the upper component, it can be the sole lower component, or there can be two lower components, each composed of an open cell polymeric foam, one being coextensive with the upper component, e.g. the product of skiving a closed cell polymeric sheet, and the other covering only part of the upper component.

In one embodiment, this invention provides a method of covering an exposed surface of water in a swimming pool, the method comprising maintaining a plurality of covering members on the surface, each of the covering members comprising (1) an upper generally laminar component having an upper surface, the upper surface being (i) above the surface of the water, and (ii) substantially impermeable to water, and at least part of the upper surface being convex, and (2) a lower component which (i) is secured to the upper component, (ii) is immersed in the water and (iii) comprises an open cell polymeric foam having water absorbed therein.

This method optionally has one or more of the following features:—

(i) the upper component is composed of a closed cell polymeric foam;

(ii) each of the covering members consists essentially of the upper component and the lower component;

(iii) the upper component has a thickness of 7-60 mm, e.g. 20-40 mm, and the lower component has a thickness of less than 40 mm, e.g. less than 5 mm, for example 0.5-40 mm or 1-5 mm;

(iv) each of the covering members comprises a monolithic article wherein the upper component is composed of a closed cell polymeric foam and has a thickness of 7-60 mm, e.g. 20-40 mm, and the lower component has a thickness of less than 5 mm, e.g. 1-5 mm;

(v) each of the covering members (a) has a circular outer periphery which is 60-300 inch, e.g. 70-150 inch, 110-160 inch, or 130-160 inch, long, and (b) has a hole which passes through the covering member, the hole having an inner circular periphery 5-40 inch, e.g. 8-20 inch, 10-16 inch, or 6-15 inch, long, and being positioned so that the distance between each point on the inner periphery and the closest point on the outer periphery is 6-30 inch, e.g. 10-30 inch or 15-24 inch, and preferably all the distances are the same;

(vi) each of the covering members has a thickness of 0.5-4.0 inch, e.g. 0.5-2.5 inch, or 0.75-2.0 inch;

(vii) the lower component is generally laminar and is coextensive with upper component; and (viii) the lower component covers only part of the lower surface of the upper component, for example is an annular ring at or near the outer periphery of the device.

In another embodiment, this invention provides a generally laminar device which comprises (1) an upper component which is composed of a closed cell polymeric foam and which has an upper surface which is substantially impermeable to water, and (2) a lower component which (i) is secured to the upper component and (ii) is composed of an open cell polymeric foam;

the device being suitable for use as a covering member on a swimming pool. This device can optionally have one or more following features:—

(i) each of the covering members consists essentially of the upper component and the lower component;

(ii) the upper component has a thickness of 7-60 mm, e.g. 20-40 mm, and the lower component has a thickness of less than 40 mm, e.g. less than 5 mm, for example 0.5-40 mm or 1-5 mm;

(iii) the device is a monolithic article wherein the upper component has a substantially uniform thickness of 7-60 mm, e.g. 20-40 mm, and the lower component has a substantially uniform thickness of less than 5 mm, e.g. 1-5 mm;

(iv) the device (a) has a circular outer periphery which is 60-300 inch, e.g. 70-150 inch, 110-160 inch, or 130-160 inch, long, and (b) has a hole which passes through the covering member, the hole having an inner circular periphery 5-40 inch, e.g. 8-20 inch, 10-16 inch, or 6-15 inch, long, and being positioned so that the distance between each point on the inner periphery and the closest point on the outer periphery is 6-30 inch, e.g. 10-30 inch or 15-24 inch, and preferably all the distances are the same;

(v) the device has a thickness of 0.5-4.0 inch, e.g. 0.5-2.5 inch, or 0.75-2.0 inch;

(vi) the lower component is generally laminar and is coextensive with upper component; and (vii) the lower component covers only part of the lower surface of the upper component, for example is an annular ring at or near the outer periphery of the device.

In another embodiment, this invention provides a method of making a device suitable for use as a covering member for a swimming pool, the method comprising.

(A) providing a sheet which is composed of a closed cell polymeric foam and which has two major surfaces which are parallel to each other and each of which is substantially impermeable to water;

(B) dividing the sheet along a plane which is parallel to the major surfaces, thus producing two sub-sheets, each sub-sheet having.

(1) a first component which is composed of a closed cell polymeric foam and which has a surface which is substantially impermeable to water, and (2) a second component which is integrally secured to the first component and which is composed of an open cell polymeric foam; and (C) cutting least one of the sub-sheets into a plurality of devices, each of the devices having (1) an outer periphery which is 60-300 inch long, and (2) a hole which passes through the device, the hole having an inner periphery 5-40 inch long and being positioned so that the distance between each point on the inner periphery and the closest point on the outer periphery is 15-24 inches.

One exemplary method for preparing such devices comprises cutting suitable shapes out of a sub-sheet produced by skiving a conventional closed cell polymeric foam sheet having a densified polymeric skin on each of the major surfaces, thus producing a sub-sheet having the densified polymeric skin on one surface and an open cell foam structure (produced by the skiving) on the opposite surface. Another exemplary process for preparing such a device comprises joining together a closed cell polymeric sheet and an open cell polymeric sheet.

This method optionally has one or more of the following features:—

(i) the first component has a thickness of 7-60 mm, e.g. 20-40 mm, and the lower component has a thickness of less than 5 mm, for example 1-5 mm;

(ii) each of the devices (a) has a circular outer periphery which is 60-300 inch, e.g. 70-150 inch, 110-160 inch, or 130-160 inch, long, and (b) has a hole which passes through the covering member, the hole having an inner circular periphery 5-40 inch, e.g. 8-20 inch, 10-16 inch, or 6-15 inch, long, and being positioned so that the distance between each point on the inner periphery and the closest point on the outer periphery is 6-30 inch, e.g. 10-30 inch or 15-24 inch, and preferably all the distances are the same;

(iii) each of the devices has a thickness of 0.5-4.0 inch, e.g. 0.5-2.5 inch, or 0.75-2.0 inch;

(iv) the sheet provided in step (A) has a uniform thickness of 30-80 mm, and the two sub-sheets produced in step (B) have the same thickness as each other.

Polymeric sheets suitable for use as starting materials in this method are well known. They are described, for example, in U.S. Pat. Nos. 5,350,544, 5,643,517, 5,647,784, 5,688,454, 6,586,074 and 7,201,958, the entire disclosure of each of which is incorporated herein by reference. They are commercially available, for example from the Foam Factory (www-closedcellfoams.com) and Sabic (plastics.Sabic.eu).

In another embodiment, this invention provides an assembly which comprises (1) a stand, and (2) a covering member on the stand, the covering member being a generally laminar device which (1) comprises (i) an upper component which is composed of a closed cell polymeric foam and which has an upper surface which is substantially impermeable to water, and (ii) a lower component which (i) is secured to the upper component and (ii) is composed of an open cell polymeric foam;

(2) has a circular outer periphery. 60-300 inch, e.g. 70-150 inch, 110-160 inch or 130-160 inch, long, and (3) has a hole which passes through the device, the hole having an inner circular periphery 5-40 inch, e.g. 8-20 inch, 10-16 inch, or 6-15 inch, long, and being positioned so that the distance between each point on the inner periphery and the closest point on the outer periphery is 6-30 inch, 10-30 inch, or 15-24 inch, and preferably all the distances are the same; and the stand comprising (1) a substantially planar base, and (2) a pole which is secured to the base and which extends from the base at right angles to the base; and the covering member resting on the base of the stand with the pole of the stand passing through the hole in the covering member. This assembly optionally has one or more of the following features:—

(i) the assembly, if placed on water, floats on the water with the pole extending substantially vertically from the water;

(ii) a plurality of substantially identical covering members rest on the stand, with the pole passing through the holes of the covering members.

The various aspects and embodiments of the invention can optionally make use of one or more of the features enumerated below. The enumerated features can be present in any combination of two or more of those features, except when the features are mutually exclusive.

(1) The outer periphery is circular or polygonal, e.g. triangular or hexagonal, or has a distinctive irregular shape, for example, the shape of a water lily or a boat.

(2) The outer periphery has a close packing shape (i.e. a shape such that a number of identical devices can be placed adjacent to each other and provide a substantially continuous surface), for example, an equilateral triangle, a square or a regular hexagon. When different devices are employed together, the outer peripheries on those devices have shapes such that the devices can be placed adjacent to each other and provide a substantially continuous surface.

(3) The inner periphery is circular or polygonal, e.g. triangular or hexagonal.

(4) The smallest distance from any point of the inner periphery to the closest point on the outer periphery is 0.8-1.2 times, e.g. 0.9 to 1.0 times, the greatest distance from any point on the inner periphery to the closest point on the outer periphery.

(5) The upper surface of the device (covering member) is sunlight-absorbing and/or non-reflective; for example, the upper surface has a relatively dark color, and the opposite surface has the same color or a relatively light color. In this way, with the upper surface having a relatively dark surface, the device can for example act as a solar heating device for a swimming pool. Alternatively, if the upper surface of the device is reflective, it can reduce the solar gain when placed on a body of liquid which is preferably protected from solar heating.

(6) The device carries markings for decorative or functional purposes, for example. "THIS SIDE UP" on the upper surface.

(7) Each device will provide useful support for a swimmer.

(8) The upper and lower components are coextensive.

(9) The upper component extends beyond the lower component.

(10) The outer periphery of the device includes both components.

(11) The inner periphery of the device includes both components.

Referring now to the drawings, FIGS. 1-10 show various views of devices of the invention having an outer periphery 11 and a central hole having an inner periphery 12. FIG. 1 is a plan view, and FIG. 2 is a cross-sectional view on line II-II of FIG. 1. FIG. 3 is an enlarged cross-section of part of the device of FIG. 1, showing an upper water-impermeable polymeric skin 15, a closed cell polymeric foam layer 16 and a lower layer 17 composed of an open cell polymeric foam. The upper skin 15 is formed by heat treatment of a closed cell polymeric foam sheet. The lower layer 17 is formed by skiving the closed cell polymeric foam sheet. FIG. 4 is a cross-section of the device of FIG. 1, after it has been floating on water for some time, and absorption of the water by the lower layer 17 has caused the upper surface of the device to have a convex shape. Each of FIGS. 5-8 is a cross-section of a device similar to that shown in FIG. 1, except that it includes an additional component 22 composed of an open cell polymeric foam. In FIGS. 5-7, 22 is an annular member close to the outer periphery. In FIG. 8, component 22 is coextensive with the upper component. In FIGS. 5-8, the upper component can consist of a closed cell polymeric foam, or it can be as shown in FIG. 3. FIG. 9 shows a device having an outer periphery of a decorative shape. FIG. 10 shows a device having a decorative pattern 18 printed or stencilled thereon. FIG. 11 shows a stand which can be used to stack devices of the invention; it can, for example, be made of PVC piping which has been capped so that the stand will float.

Use of the devices of the invention reduces evaporation of water from swimming pools, thus reducing loss of heat and chemicals from the water. The devices are easy to handle and can be used on pools of any shape. The convex shape of the preferred devices reduces the danger that wind will blow the devices off the surface of the water, and also limits pooling of rainwater and debris on top of the devices. Especially when the devices which are used together have the same shape, the hole which passes through the preferred devices makes them easy to store when not in use.

The invention claimed is:

1. A method of covering an exposed surface of water in a swimming pool, the method comprising maintaining a plurality of generally laminar covering members on the surface, each of the covering members comprising (1) an upper component which is composed of a closed cell polymeric foam and which has an upper surface, at least part of the upper surface being convex, and the upper surface being (i) above the surface of the water and (ii) substantially impermeable to water, and (2) a lower component which (i) is secured to the upper component, and (ii) comprises a lower portion which is immersed in the water and comprises an open cell polymeric foam having water absorbed therein.

2. A method according to claim 1 wherein each of the covering members consists essentially of the upper component and the lower component.

3. A method according to claim 2 wherein the upper component has a thickness of 7-60 mm and the lower component has a thickness of 0.5-40 mm.

4. A method according to claim 3 wherein each of the covering members is a monolithic article wherein the upper component has a thickness of 20-40 mm, and the lower component has a thickness of 1-5 mm.

5. A method according to claim 1 wherein the highest point on the convex upper surface is at least 0.5 inch higher than the lowest point on the convex surface.

6. A method according to claim 1 wherein each of the covering members (1) has a circular outer periphery which is 60-300 inch long, and (2) has a hole which passes through the covering member, the hole (i) having an inner circular periphery 5-40 inch long, and (ii) being positioned so that the distance between each point on the inner periphery and the closest point on the outer periphery is the same and is 15-24 inches.

7. A method according to claim 1 wherein the closed cell polymeric foam has a density of 1.5-7 pounds per cubic foot.

8. A method according to claim 1 wherein the closed cell polymeric foam is composed of a polyolefin containing a UV stabilizer.

9. A method of covering an exposed surface of water in a swimming pool, the method comprising maintaining a plurality of generally laminar covering members on the surface, each of the covering members comprising (1) an upper component having an upper surface, at least part of the upper surface being convex, the highest point on the convex upper surface being at least 0.5 inch higher than the lowest point on the convex surface, and the upper surface being (i) above the surface of the water and (ii) substantially impermeable to water, and (2) a lower component which (i) is secured to the upper component, and (ii) comprises a lower portion which is immersed in the water and comprises an open cell polymeric foam having water absorbed therein.

10. A method according to claim 9 wherein each of the covering members consists essentially of the upper component and the lower component.

11. A method according to claim 10 wherein the upper component has a thickness of 7-60 mm and the lower component has a thickness of 0.5-40 mm.

12. A method according to claim 11 wherein each of the covering members is a monolithic article wherein the upper component has a thickness of 20-40 mm, and the lower component has a thickness of 1-5 mm.

13. A method according to claim 9 wherein each of the covering members (1) has a circular outer periphery which is 60-300 inch long, and (2) has a hole which passes through the covering member, the hole (i) having an inner circular periphery 5-40 inch long, and (ii) being positioned so that the distance between each point on the inner periphery and the closest point on the outer periphery is the same and is 15-24 inches.

14. A method according to claim 9 wherein the upper component is composed of a closed cell polymeric foam and the closed cell polymeric foam has a density of 1.5-7 pounds per cubic foot.

15. A method according to claim 14 wherein the closed cell polymeric foam is composed of a polyolefin containing a UV stabilizer.

16. A method according to claim 9 wherein each of the covering members (1) has a circular outer periphery which is 60-300 inch long, and (2) has a hole which passes through the covering member, the hole (i) having an inner circular periphery 5-40 inch long, and (ii) being positioned so that the distance between each point on the inner periphery and the closest point on the outer periphery is the same and is 15-24 inches.

17. A method of covering an exposed surface of water in a swimming pool, the method comprising maintaining a plurality of separate, generally laminar covering members on the surface, each of the separate covering members (a) having an outer periphery which is circular or polygonal and (b) comprising (1) an upper component having an upper surface, at least part of the upper surface being convex, the highest point on the convex upper surface being at least 0.5 inch higher than the lowest point on the convex surface, and the upper surface being (i) above the surface of the water and (ii) substantially impermeable to water, and (2) a lower component which (i) is secured to the upper component, and (ii) comprises a lower portion which is immersed in the water and comprises an open cell polymeric foam having water absorbed therein.

18. A method according to claim 17 wherein each of the separate covering members is a monolithic article which consists essentially of the upper component and the lower component, the upper component has a thickness of 7-60 mm, and the lower component has a thickness of 0.5-40 mm.

* * * * *